US006010840A

United States Patent [19]

Verrept et al.

[11] Patent Number: 6,010,840

[45] Date of Patent: Jan. 4, 2000

[54] METHOD FOR PREPARING TABULAR GRAINS RICH IN SILVER CHLORIDE WITH REDUCED THICKNESS GROWTH AND IMPROVED HOMOGENEITY

[75] Inventors: Peter Verrept, Avelgem; Ann Verbeeck, Begijnendijk; Nadia Vermant, Mortsel; Frank Louwet, Diepenbeek, all of Belgium

[73] Assignee: Agfa-Gevaert, N.V., Mortsel, Belgium

[21] Appl. No.: 09/232,733

[22] Filed: Jan. 19, 1999

Related U.S. Application Data

[60] Provisional application No. 60/077,361, Mar. 9, 1998.

[30] Foreign Application Priority Data

Jan. 27, 1998 [GB] United Kingdom ..... 98200236

[51] Int. Cl.[7] ..... G03C 1/035; G03C 1/043; G03C 1/053

[52] U.S. Cl. ..... 430/567; 430/569; 430/634; 430/637; 430/638

[58] Field of Search ..... 430/567, 569, 430/634, 637, 638

[56] References Cited

U.S. PATENT DOCUMENTS

| | | | |
|---|---|---|---|
| 4,943,618 | 7/1990 | Stoy et al. | 525/340 |
| 5,215,879 | 6/1993 | Suzuki et al. | 430/569 |
| 5,252,692 | 10/1993 | Lovy et al. | 526/342 |
| 5,753,422 | 5/1998 | Shibahara et al. | 430/379 |
| 5,759,759 | 6/1998 | Adin et al. | 430/567 |
| 5,807,664 | 9/1998 | Suzuki | 430/567 |

FOREIGN PATENT DOCUMENTS

| | | | |
|---|---|---|---|
| 0 518 066 A1 | 12/1992 | European Pat. Off. | G03C 1/035 |
| 0 596 469 A1 | 5/1994 | European Pat. Off. | G03C 1/005 |
| 0 762 192 A1 | 3/1997 | European Pat. Off. | G03C 1/005 |

*Primary Examiner*—Mark F. Huff
*Attorney, Agent, or Firm*—Breiner & Breiner

[57] ABSTRACT

A method has been described for preparing a gelatinous emulsion having grains rich in silver choride, wherein at least 70%, and more preferred 90%, of the total projected area of all grains is provided by {111} tabular grains having an average aspect ratio of more than 2:1, an average equivalent circular diameter of at least 0.3 μm and an average thickness of from 0.05 to 0.25 μm , wherein a percent variation on average equivalent circular diameter of said tabular grains is 30% or less and wherein a percent variation on average thickness of said tabular grains is 20% or less and wherein said tabular grains are present in percent numerical amounts of at least 90%, said method comprising following steps:

preparing in a reaction vessel a dispersion medium comprising an initial amount of a crystal habit modifying agent;

precipitating therein silver halide crystal nuclei by double-jet precipitation of an aqueous silver nitrate and an aqueous solution comprising halide ions, wherein less than 10% by weight of a total amount of silver nitrate used is consumed;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed, characterized in that during at least one of the said steps at least one compound is added to the said reaction vessel, said compound being a hydrophilic amphoteric block copolymer containing (i) a non-ionic acrylic block comprising a sequence of units having pendant nitrile groups according to formula I given in the claims and (ii) a acrylamid(in)ic block comprising a sequence of units according to formula II given in the claims, said hydrophilic amphoteric block copolymer further comprising within said acrylamid(in)ic block(s) units having pendant acidic groups or salts thereof as well as units having pendant basic groups or salts thereof. Emulsions having tabular grains prepared according to the method of the present invention and light-sensitive silver halide photographic materials wherein said emulsions have been coated in light-sensitive layers have also been disclosed.

14 Claims, No Drawings

METHOD FOR PREPARING TABULAR GRAINS RICH IN SILVER CHLORIDE WITH REDUCED THICKNESS GROWTH AND IMPROVED HOMOGENEITY

This application claims benefit of U.S. Provisional Application No. 60/077,361, filed Mar. 9, 1998.

FIELD OF THE INVENTION

The present invention is related with a preparation method of {111} tabular emulsion grains rich in silver chloride showing less thickness growth and improved homogeneity in diameter and in thickness and with silver halide photographic materials comprising said emulsions.

BACKGROUND OF THE INVENTION

Tabular silver halide grains are grains possessing two parallel crystal faces with an aspect ratio of two or more. Said aspect ratio is defined as the ratio between the diameter of a circle having an equivalent surface area as one of these crystal faces, and the thickness, being the distance between the two major faces.

Tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72.

Early patent literature includes Bogg U.S. Pat. No. 4,063,951, Lewis U.S. Pat. No. 4,067,739 and Maternaghan U.S. Pat. Nos. 4,150,994; 4,184,877 and 4,184,878. However the tabular grains described herein cannot be regarded as showing a high diameter to thickness ratio, commonly termed aspect ratio. In a number of US-A's filed in 1981 and issued in 1984 tabular grains with high aspect ratio and their advantages in photographic applications are described as e.g. U.S. Pat. Nos. 4,434,226; 4,439,520; 4,425,425 and 4,425,426 and in Research Disclosure, Volume 225, January 1983, Item 22534.

For radiographic applications the main photographic advantages of tabular grains compared to normal globular grains are a high covering power at high forehardening levels as described in U.S. Pat. No. 4,414,304, a high developability and higher sharpness especially in double side coated spectrally sensitized materials thereby lowering of cross-over as specifically described in U.S. Pat. Nos. 4,425,425 and 4,425,426.

In the references on {111} tabular grains cited above especially silver bromide or silver iodobromide emulsions having a high sensitivity are disclosed, although it has been shown that high speed can also be achieved with tabular silver halide grains rich in silver chloride as in EP-A 0 678 772.

Anisotropic growth characteristics for the said tabular grains are known to be due to the formation of parallel twin planes in the nucleation step of the precipitation. However for the said {111} tabular silver halide grains rich in silver chloride use of a crystal habit modifier in relatively high amounts is therefore required, as has been illustrated in U.S. Pat. Nos. 4,713,323; 4,804,621; 5,176,692; 5,183,732; 5,185,239; 5,252,452; 5,286,621; 5,298,385 and 5,298,388. Treatment with iodide of tabular grain emulsions having {111} crystals rich in silver chloride in order to get an enhanced morphological stability and enhanced photographic performance has been disclosed in EP-A 0 678 772 and in Research Disclosure 388046, published Aug. 1, 1996.

However as a global result fairly heterogeneous emulsion crystal distributions are obtained: a common variability coefficient (defined as a ratio between average standard deviation on equivalent circular diameter and the said average equivalent circular diameter) of 0.30 to 0.60 is calculated, partly due to the presence of quite a large number of non-tabular grains having a sphere equivalent diameter of less than 0.3 $\mu$m. Moreover differences in thickness growth are observed, said differences leading to unevenness as a consequence of observed differences in image tone.

Heterodispersity of grain morphology further leads to e.g. uncontrolled chemical and spectral sensitization, lower contrast and lower covering power, thereby loosing typical advantages of the said grains as referred to hereinbefore.

Until now efforts in order to get more monodisperse tabular silver halide crystal distributions in emulsion preparation have been directed towards silver halide crystals rich in silver bromide as has e.g. been described in U.S. Pat. Nos. 4,797,354; 5,147,771; 5,147,772; 5,147,773; 5,171,659; 5,248,587; 5,204,235; 5,210,013; 5,215,879; 5,250,403; 5,252,442, 5,252,453; 5,254,453; 5,318,888; 5,439,787; 5,472,837; 5,482,826 and 5,484,697 and in Research Disclosure No. 391, p. 713–723 (1996).

In order to control thickness growth for tabular {111} grains rich in silver chloride a solution has been proposed as disclosed in EP-A 0 866 362: therein a preparation method has been given wherein the dispersion medium during nucleation is held constant at an initial pH value between 6.0 and 9.0; further setting pH to a value lower than 6.0 for at least 30 seconds, between ending the said nucleation step and ending the said growing step; followed by resetting pH to the said initial pH value.

Nevertheless the problem remains of too low a covering power, probably due to the presence of still a large number of grains showing a higher thickness than the average thickness observed.

As a consequence many attempts have been made in order to improve the degree of homogeneity of the size and shape of the crystals but the majority of them is related with tabular grains rich in silver bromide again. So radiographic materials comprising emulsions having monodisperse tabular silver brom(oiod)ide crystals have e.g. been described in U.S. Pat. Nos. 5,252,442 and 5,508,158. The same preparation methods as for the forementioned tabular grains rich in silver bromide can however not be applied as such in preparing tabular grains rich in silver chloride, especially due to the presence of crystal habit modifiers, usually adenine, as this leads to the disadvantages set forth hereinbefore.

OBJECTS OF THE INVENTION

Therefore it is a first object of the present invention to provide a method for preparing tabular {111} grains rich in silver chloride having a high degree of morphologic homogeneity in that thickness growth is reduced to a large extent. More particularly hexagonal tabular {111} crystals having a homogeneous crystal diameter are envisaged in a percent amount as high as possible versus other grain shapes that are leading to the presence of redundant amounts of silver and which do not contribute effectively to desired photographic properties as e.g. low coating amounts of silver showing a high covering power after processing.

Other objects will become apparent from the description hereinafter, wherein preferred embodiments of the invention are disclosed and further summarized in the dependent claims.

SUMMARY OF THE INVENTION

A method has therefor been described for preparing a gelatinous emulsion having grains rich in silver choride, wherein at least 70%, and more preferred 90%, of the total projected area of all grains is provided by {111} tabular grains having an average aspect ratio of more than 2:1, an average equivalent circular diameter of at least 0.3 μm and an average thickness of from 0.05 to 0.25 μm , wherein a percent variation on average equivalent circular diameter of said tabular grains is 30% or less and wherein a percent variation on average thickness of said tabular grains is 20% or less and wherein said tabular grains are present in percent numerical amounts of at least 90%, said method comprising following steps preparing in a reaction vessel a dispersion medium comprising an initial amount of a crystal habit modifying agent;

precipitating therein silver halide crystal nuclei by double-jet precipitation of an aqueous silver nitrate and an aqueous solution comprising halide ions, wherein less than 10% by weight of a total amount of silver nitrate used is consumed;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed, characterized in that during at least one of the said steps at least one compound is added to the said reaction vessel, said compound being a hydrophilic amphoteric block copolymer containing (i) a non-ionic acrylic block comprising a sequence of units having pendant nitrile groups according to formula I given in the claims and (ii) a acrylamid (in)ic block comprising a sequence of units according to formula II given in the claims, said hydrophilic amphoteric block copolymer further comprising within said acrylamid(in)ic block(s) units having pendant acidic groups or salts thereof as well as units having pendant basic groups or salts thereof. Emulsions having tabular grains prepared according to the method of the present invention and light-sensitive silver halide photographic materials wherein said emulsions have been coated in light-sensitive layers have also been disclosed.

The formulae I and II are further disclosed hereinafter in the detailed description and in the claims.

DETAILED DESCRIPTION OF THE INVENTION

The hydrophilic amphoteric block copolymers added to the reaction vessel according to the present invention are acrylic polymers characterized by three essential features, which will be explained hereinafter.

The term "acrylic" as used herein designates any derivative of the acrylic acids having a basic structure $CH_2{=}CR{-}COOH$ regardless the nature of the substituent R. Preferred acrylic monomers are derivatives of acrylic acid (R=H) and methacrylic acid ($R{=}CH_3$).

The acrylic polymer derivatives used according to the present invention are so-called amphoteric polymers carrying both anionic and cationic groups in the same polymer chain. Such ionic groups are capable of mutual interactions which provide the polymer with certain special properties: pH dependant swelling, pH dependant crosslinking, etc. Amphoteric polymers form internal salts at a certain well defined pH value called isoelectric point and accordingly, the polymer in this state has a minimum solubility and/or swelling in water. In this respect, amphoteric (meth) acrylates are analogous to proteins and other natural polymers such as gelatin.

A first essential feature of the hydrophilic amphoteric block copolymers used according to the present invention is the presence of a non-ionic block comprising a sequence of units having pendant nitrile groups according to formula I, Formula I

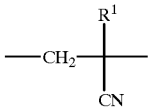

wherein $R^1$ is hydrogen, alkyl or substituted alkyl.

This non-ionic block may be a continuous sequence of the same monomer in order to form a homopolymer, preferably polyacrylonitrile or polymethacrylonitrile, but the block may also be a random polymer of e.g. acrylonitrile and methacrylonitrile units. The number of units comprised in said non-ionic block is two or more, but preferably at least about ten. According to the present invention, the units of formula I may be separated from one another by other non-ionic acrylic co-monomers without a pendant nitrile group. The ratio of such non-CN co-monomers versus the monomers according to formula I may be as high as 50% but preferably the amount of non-CN co-monomers is kept below 15 molar % for optimum results.

A second essential feature of the hydrophilic amphoteric block copolymers used according to the present invention is the presence of a so-called acrylamid(in)ic block comprising a sequence of acrylamidic or acrylamidinic units corresponding to formula II, Formula II

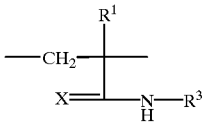

wherein $R^2$ is hydrogen, alkyl or substituted alkyl, preferably hydrogen or methyl, $R^3$ is hydrogen, alkyl or substituted alkyl, aryl or substituted aryl, and X is O or NH. This sequence of acrylamides or acrylamidines may be a homopolymer or a random polymer. The acrylamid(in)ic units may be N-substituted. The N-substituent $R^3$ can be a carrier of various functional groups, including the acidic and basic groups referred to hereinafter. Hydrophobic moieties can also be present in this acrylamid(in)ic block, obtained by N-substitution with $R^3$ being a non-polar substituent such as an alkyl with 4 to 24 carbon atoms, an aryl group, oxygen containing substituents such as hydroxyl, esters, saccharides or epoxides, an alkylsiloxane $-(Si(R)_2{-}O)_n{-}Si(R)_3$ where n is 0 to about 100 and R is an alkyl with 4 to 24 carbon atoms. When $R^3$ is an alkyl or aryl group, it may be substituted with e.g. one or more halogen atoms, lactone, lactame, nitrile, nitro or nitroso groups.

A third essential feature of the hydrophilic amphoteric block copolymers used according to the present invention is the presence of acrylic units having pendant acidic groups as well as acrylic units having pendant basic groups within the acrylamid(in)ic block(s).

The acidic and basic groups may be randomly distributed over some or all of the acrylamid(in)ic blocks of the polymer. Each of said acrylamid(in)ic blocks may contain either only acidic groups, only basic groups or a mixture of acidic and basic groups. The polymers used according to the present invention can have a molar excess of either group, thus having isoelectric points at either alkaline or acidic pH, depending on the molar ratio between the basic groups and acidic groups which may vary from about 1:20 to about 20:1, but preferably from about 1:10 to about 10:1. Because of their strong mutual interactions, the acidic and basic groups affect the properties of the polymer already at very low concentrations (as low as 1 molar %), but preferably the concentration of ionic groups is higher than 5 molar %.

In a preferred embodiment, the units having pendant acidic groups are of the general formulae III or IV or are salts thereof. If present as a salt, preferred counterions are metallic ions or nitrogen containing bases.

Formula III

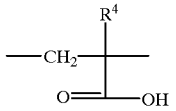

In formula III $R^4$ represents hydrogen, alkyl or substituted alkyl. Preferably, $R^4$ is hydrogen or methyl.

Formula IV

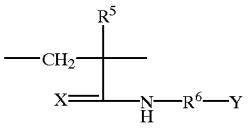

In formula IV $R^5$ represents hydrogen, alkyl or substituted alkyl, preferably hydrogen or methyl, X is O or NH, $R^6$ is an organic linking group having at least one carbon atom, preferably ethylene or substituted ethylene, and Y is —COOH, $—OPO_3H_2$, $—SO_3H$ or $—OSO_3H$. The units having pendant basic groups are preferably of the general formulae V or VI or are salts thereof. If present as a salt, the counterions may be e.g. carboxylate, sulphate, sulphonate, phosphate, nitrate, nitrite, carbonate or halide.

Formula V

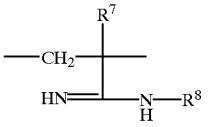

In formula V $R^7$ represents hydrogen, alkyl or substituted alkyl, preferably hydrogen or methyl, and $R^8$ represents hydrogen, alkyl or substituted alkyl, aryl or substituted aryl. Formula V is limited to amidines, as amides are generally not being considered basic.

Formula VI

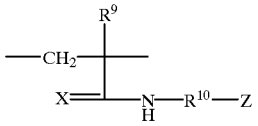

In formula VI $R^9$ represents hydrogen, alkyl or substituted alkyl, preferably hydrogen or methyl, X is O or NH, $R^{10}$ is an organic linking group having at least one carbon atom, preferably ethylene or substituted ethylene, and Z is a nitrogen containing base. Preferred examples of such nitrogen containing bases are primary, secondary and tertiary amines, quaternary bases, pyridine or naphtyridine derivatives, guanidines, amidines, imines and imidines.

When X=NH in formula IV, the unit corresponds also to formula V thereby illustrating that such a unit comprises acidic groups (Y) as well as basic groups (the amidine function). As a result units having a pendant group —CNH—NH—$R^6$—Y are amphoteric per se.

Therefore, a block copolymer with a polyacrylonitrile block of formula I and an acrylamid(in)ic block of formula II comprising units with the pendant group —CNH—NH—$R^6$—Y as sole ionic units within said acrylamid(in)ic block are also hydrophylic amphoteric block copolymers within the scope of the present invention.

A highly preferred example of a specific hydrophilic amphoteric block copolymer used according to the present invention is a polymer, referred to herein as HYPAN TC240® from HYMEDICS, comprising N-(2-sulpho-ethyl)-acrylamide and N-(2-sulpho-ethyl)-acrylamidine. HYPAN TC240® may be represented by formula VII:

Formula VII

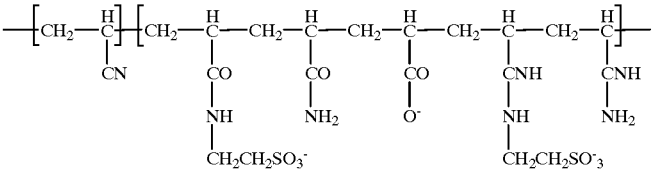

It is generally understood in the art that it is impossible to characterize specific polymers with a single, clear and concise structural formula. Therefore, the formula given above should not be interpreted literally. The brackets are used to indicate that the acrylonitrile units are organized in separate blocks other than the blocks containing the acrylamide and acrylamidine units. In addition, the five different units present in the acrylamid(in)e block of formula VII are not organized within the blocks in the exact sequence as given above but are randomly distributed over the acrylamid (in)ic blocks. The frequency distribution of the units of HYPAN TC240® is approximately as follows:

| Pendant group | Frequency |
|---|---|
| —CN | 19% |
| —CO—NH—$CH_2$—$CH_2SO_3^-$ and —CNH—NH—$CH_2$—$CH_2$—$SO_3^-$ | 45% |
| —CO—$NH_2$ and —CNH—$NH_2$ | 24% |
| —$COO^-$ | 12% |

The hydrophilic amphoteric polymers used in the method according to the present invention can be synthesized according to the methods disclosed in U.S. Pat. Nos. 5,252,692 and 4,943,618 which are incorporated herein by reference. A preferred method is the hydrolysis of the CN groups of polyacrylonitrile dissolved in a mixture of a solvent, a primary amine, water and an optional basic catalyst. If the reaction conditions are suitably selected, the hydrolysis of the CN groups proceeds via a so-called "zipper mechanism", which may lead to structures as indicated in formula VII with various substituents being organized in blocks rather than being randomly distributed along the polymer chain. The resulting block copolymers may optionally be covalently or physically crosslinked and may form hydrogels as they are swellable rather than soluble in water. The average molecular weight is typically 150,000 though block copolymers with a much higher or much lower molecular weight can also be used according to the present invention.

The very significant effect of the polymers used in the method according to the present invention and upon the properties of the photographic materials comprising emulsions prepared by the method of the present invention and containing such a polymer will be illustrated by the examples.

According to the method of the present invention said polymers are added to the reaction vessel, initially comprising a crystal habit grain modifying agent in order to prepare a suitable dispersion medium wherein nucleation takes place in the nucleation step, but addition, in one or more parts in different steps as e.g. after the said nucleation step, before or during one of the following growth steps is possible. Moreover addition during physical ripening after growth is not excluded and addition of the said polymers before or during redispersion and even to the coating solutions before coating is not excluded. In a preferred embodiment and in order to provide a better controll and reproducibility of the production process said copolymer(s) is(are) added before precipitation of silver halide, preferably with a minimum of about 10% of the total amount of hydrophilic protective colloid present in the nucleation step.

According to the method of the present invention an emulsion having {111} tabular grains rich in silver choride is thus prepared wherein said grains, being composed of silver chloride, silver chlorobromide, silver chloroiodide or silver chlorobromoiodide have at least 50 mole % of silver chloride and more preferably more than 90% of silver chloride. The said {111} tabular emulsion grains are further characterized by a total projective area of at least 70%, and more preferably 90%, of the total projected area of all grains and an average aspect ratio of more than 2:1, an average equivalent circular diameter of at least 0.3 $\mu$m up to at most 5 $\mu$m, more preferably from 0.4 up to 2.0 $\mu$m and an average thickness of from 0.05 to 0.25 $\mu$m, wherein a percent variation on average equivalent circular diameter (also called "ECD") of said tabular grains is 30% or less, normally in the range between 20% and 30%. Taking into account all grains present in the emulsion then a percent variation can be found which is higher to a considerable extent, reaching a variation of from 30% up to even about 60%. Therein the said average "ECD" is defined as an average value calculated from the surface area of all {111} tabular grains, said equivalent circular diameter expressing the diameter of a circle having the same (=equivalent) surface as the surface of the corresponding tabular grain.

Moreover according to the present invention, the presence in emulsion preparation of the hydrophilic amphoteric block-copolymers as disclosed hereinbefore makes the percent variation on average grain thickness of the tabular grains present reduce to a level of 20% or less: preferably percent variations on thickness are in the range between 10 and 20%.

According to the present invention in said {111} tabular grains having a silver chloroiodide or a silver chlorobromoiodide composition, iodide is present in an amount of up to 3 mole %. Iodide ions are provided by using aqueous solutions of inorganic salts thereof as e.g. potassium iodide, sodium iodide or ammonium iodide as described in RD 39433, published January 1997, but as an alternative iodide ions provided by organic compounds releasing iodide ions are very useful as has e.g. been described in EP-A's 0 561 415, 0 563 701, 0 563 708, 0 649 052 and 0 651 284, in WO 96/13759 and in RD 39423, published January 1997. Especially in order to obtain a more homogeneous iodide distribution in the crystal lattice of individual crystals and over the whole crystal population iodide ions provided by organic agents releasing iodide ions are even preferred. Examples of such iodide ion releasers are mono iodide acetic acid, mono iodide propionic acid, mono iodide ethanol and even hydrogels containing iodide ions, capable to generate iodide ions. Generation of iodide ions is triggered in the preparation method by changing the pH value in the reaction vessel during or, preferably, after addition of the said organic agent releasing iodide ions, wherein this pH change is performed therein in such a way as required by the method of the present invention. Opposite to the addition of potassium iodide as a source of iodide ions the said organic compounds releasing iodide ions are leading to a more homogeneous iodide ion distribution over the different tabular crystals, thus avoiding undefined heterogeneities and irreproducibilities.

In another embodiment according to the method of the present invention said tabular grains are enriched in iodide by adding silver iodide microcrystals having an average crystal size of up to at most 0.05 $\mu$m. Generation of iodide ions is triggered therein by differences in solubility between large {111} tabular silver chlor(oiod)ide or silver chlorobrom(oiodid)ide crystals and such fine silver iodide microcrystals, a phenomenon that is well-known as "Ostwald ripening". Simple conversion techniques making use of the well-known inorganic iodide salts (preferably alkaline earth metal salts such as potassium or sodium iodide) can however be applied.

Combinations of inorganic and organic agents providing iodide ions may also be useful. The presence of iodide ions thereby stabilizes the (111)-crystal faces: it has e.g. been established that the concentration of crystal habit modifier present at the surface of the tabular grains rich in silver chloride can be decreased to a considerable extent as iodide ions, provided to the surface of the said grains, lead to preservation of a stable crystal habit. Iodide ions can thus replace conventional crystal habit modifiers such as adenine, etc. Other compounds as spectral sensitizers or stabilizers can also be used as suitable compounds replacing said crystal habit modifiers due to their crystal habit stabilizing action. The presence of iodide ions at the crystal surface of tabular crystals rich in chloride is moreover in favour of adsorption of spectral sensitizers at that large {111} tabular crystal surface due to improved J-aggregation. As a consequence an improved absorption of light in the wavelength range for which the crystal has been made sensitive is observed.

According to the preparation method of {111} tabular silver halide grains rich in silver chloride a dispersion medium comprising an initial amount of a crystal habit modifying agent is indeed added to the reaction vessel. Compounds that are useful as crystal habit modifier of crystals rich in silver chloride include substances disclosed in EP-A's 0 430 196, 0 481 133 and 0 532 801 and in U.S.

Pat. Nos. 5,176,991; 5,176,992; 5,178,997; 5,178,998; 5,183,732; 5,185,239; 5,217,858; 5,221,602; 5,252,452; 5,264,337; 5,272,052; 5,298,385; 5,298,387; 5,298,388; 5,399,478; 5,405,738; 5,411,852 and 5,418,125.

According to the method of the present invention the crystal habit growth modifier is adenine, a 2-hydro-amino-azine or a 4-amino-pyrazolo[3,4,d] pyrimidine. Besides as a hydrophilic protective colloid e.g. gelatin, colloidal silica, potato starch, dextranes, acrylamides or a combination thereof can be present. Such protective colloids or binders have been described in a general review published Sep. 1, 1996, in Research Disclosure No. 38957. It is clear that as according to the method of the present invention a gelatinous emulsion is formed, gelatin remains an essential hydrophilic protective colloid during preparation of the said emulsion. In a preferred embodiment said gelatin is present in the reaction vessel wherein the dispersion medium is prepared before nucleation. In an even more preferred embodiment only a small part of the gelatin is added before nucleation (having more particularly a methionine content of less than 30 $\mu$moles per gram of said gelatin), whereas higher amounts are added in the following steps( optionally having a methionine content of less than 30 $\mu$moles per gram of said gelatin), preferably during the physical ripening steps between nucleation and growth or between consecutive growth steps. Even after ending growth an amount of gelatin, can be added, but it is preferable to add the said amount after flocculation or ultrafiltration in order to provide good redispersion properties for the thus prepared emulsions. Gelatins for use in the preparation of photographic emulsions have been described e.g. in Research Disclosure No.38957, Chapter 2, published Sep. 1, 1996.

When during nucleation and/or a physical ripening step inbetween the nucleation step and the first growth step, gelatin is present as a hydrophilic dispersion medium in the reaction vessel, a ratio of gelatin to silver, expressed as an equivalent amount of silver nitrate, of less than 10 (about 4 to 7) is calculated, which is rather high. Said ratio, also called "gesi" decreases during the following growth steps to a value of about 0.35 to 0.25. Gelatin, as well as the hydrophilic amphoteric block copolymers used in the method of the present invention, may however be added inbetween or during the nucleation step and the first growth step and/or inbetween or during different growth steps.

Preparation methods of tabular grains having a {111} tabular crystal habit are normally characterized by the presence of a nucleation step, wherein preferably up to at most 10%, and more preferably at most 5% of the total amount of silver salt in a diluted medium is consumed at a constant temperature between 35° C. and 55° C., other temperature intervals however not being excluded. Precipitating silver halide crystal nuclei in the reaction vessel proceeds by double-jet precipitation of an aqueous silver nitrate and an aqueous solution comprising halide ions, wherein less than 10% by weight of a total amount of silver nitrate used is consumed. If iodide is present a concentration of not more than 0.5% is preferred in the nucleation step in order to prevent formation of nuclei in an excessive amount. Although bromide may be present in the nucleation step if silver chlorobromoiodide crystals are prepared, its absence is preferred and chloride present therein in an amount of at least 99.5% is commonly occurring. One or more growth steps, with at least one physical ripening step inbetween, are normally following said nucleation step. Thus growing the silver halide crystal nuclei rich in silver chloride by further precipitation of silver halide proceeds by means of double-jet precipitation of an aqueous silver nitrate solution and an aqueous solution comprising halide ions, wherein more than 90%, and more preferably more than 95% by weight of a total amount of silver nitrate is consumed.

In order to provide enough silver and halide ions proportional with the growing rate of the growing crystal surface it is advantageous to accelerate the addition rate of silver and halide salts as a function of time. Also from an economical point of view this measure is advantageous as this is a time saving procedure. In combination therewith the growing volume in the reaction vessel, leading to an increased dilution of emulsion crystals in the reaction vessel, may be held constant by removing excessive amounts of soluble alkaline nitrates and of water by means of dialysis and/or ultrafiltration.

According to the method of the present invention growing the said nuclei is performed by double jet precipitation, wherein iodide salt solutions are optionally present in the said halide salt solutions essentially consisting of chloride salts and optionally of bromide salts characterized further by maintaining the said chloride salts in the reaction vessel at a constant concentration of less than 0.15 M. During said growth step(s) nuclei are thus further grown by double jet precipitation, wherein the rest of the total amount of silver is consumed and wherein iodide salts are optionally present in halide salt solutions (normally as alkali iodide solution in an alkali chloride solution, wherein chloride salts are present in excessive amounts versus iodide salts) essentially consisting of chloride salts and optionally of bromide salts (if silver chlorobromoiodide crystals are prepared).

During physical ripening an increase of the temperature of the reaction vessel to about 70° C. may be performed in order to hold said temperature at the same value during growth of the tabular grains. Preferably pH remains at the same value of about 6.0 unless, as set forth e.g. in EP-A 0 866 362 the setting of pH to a value of lower than 6.0 for least 30 seconds is performed, followed by resetting pH to the said initial pH, in order to further control thickness of the grains and homogeneity of the crystal size distribution. Application of the method of the present invention leads to a homogeneity, mathematically expressed as variability coefficient on average equivalent circular diameter and on average thickness, of less than 0.30, i.e. between 0.10 and 0.30.

In thin tabular silver chlorobromoiodide or silver chloroiodide emulsions comprising iodide in an amount of from 0.1 mole % up to 3 mole %, as well as in the corresponding emulsions free from iodide the halide distribution in the tabular grains is homogeneous or heterogeneous over the whole crystal volume. When phases differing in silver halide composition are present over the crystal volume said crystal has a "core-shell" structure. More than one shell can be present and between different phases it can be recommended to have a phase enriched in silver bromide and/or in silver iodide by applying the so-called conversion technique during preparation.

In a preferred embodiment, according to the method of the present invention, during and/or after growing the said nuclei at least one conversion step is performed, wherein converting the said emulsion grains is performed by adding inorganic bromide and/or iodide salts and/or organic bromide and/or iodide releasing compounds to the reaction vessel.

In still another embodiment during and/or after growing the said nuclei at least one conversion step is performed, wherein converting the said emulsion grains is performed by adding silver iodide or silver bromide microcrystals having an average crystal size of at most 0.05 $\mu$m.

According to the method of the present invention in one embodiment silver chlorobromide emulsions are thus prepared by converting the said emulsion grains so that the said emulsion comprises {111} tabular grains having a variable bromide profile, in that the grains have been enriched in bromide at the crystal surface, said profile being characterized by the presence of bromide ions in the crystal volume in lower amounts than at the crystal surface of the said tabular grains and in that, in a more preferred embodiment, an amount of 50 to 100 mole % of the total amount of bromide ions is located at the surface of said tabular grains.

According to the method of the present invention in another embodiment silver chlorobromoiodide or silver chloroiodide emulsions are thus prepared by converting the said emulsion grains so that the said emulsion comprises tabular grains having a variable iodide profile, in that the grains have been enriched in iodide at the crystal surface, said profile being characterized by the presence of iodide ions (and optionally bromide ions) in the crystal volume in lower amounts than at the crystal surface of the said tabular grains and in that an amount of 50 to 100 mole % of the total amount of iodide ions (and optionally bromide ions) is located at the surface of said tabular grains.

When phases differing in silver halide composition are present over the crystal volume said crystal is said to have a core-shell structure. More than one shell can thus be present, depending on the number of growth steps and inbetween said different phases a phase enriched in silver iodide and/or silver bromide can be applied.

Although the presence of iodide is preferred with respect to intrinsic and to spectral sensitivity it is recommended to limit average iodide concentrations to a percent amount, based on silver of from 0.05 mole % up to 1.3 mole % and even more preferably to limit them from 0.05 mole % to 1.3 mole %, based on the total silver amount as higher concentrations retard development and lead to unsatisfactory sensitivities. Moreover the velocity of fixation can be disturbed in that case and as a consequence residual colouration may be unavoidable. In EP-A 0 678 772 e.g. an excessive amount of iodide has been provided by conversion at the end of precipitation and thus at the end of the last growth step in order to have a total concentration of iodide of 1.3 mole % in the silver chloroiodide emulsion thus obtained.

Bromide ion concentrations of up to 25 mole % based on the total silver amounts are contemplated, but in order to avoid a strong inhibition of the processing and enhanced replenishing amounts of developer and/or fixer solutions, the {111} tabular silver chlorobro-moiodide or silver chlorobromide emulsion crystals prepared according to the method of the present invention preferably have an amount of silver bromide of not more than 10 mole %, based on silver.

In order to reduce the amount of replenisher in the processing of exposed silver halide materials comprising light-sensitive emulsions as described before, it is even more preferable to reduce the amount of bromide ions to less than 5 mole %. Bromide ions may therein be provided from at least one inorganic and/or organic agent providing bromide ions.

According to the present invention, a photographic material is provided comprising a support and on one or on both sides thereof one or more silver halide emulsion layer(s) coated from a gelatinous emulsion prepared as set forth hereinbefore, and more preferably a photographic material which is a single-side or double-side coated radiographic material.

The hydrophilic amphoteric block copolymers described above are present in light-sensitive emulsion layers coated from emulsions having {111} tabular grains rich in silver chloride, but their presence in another hydrophilic layer, as e.g. in an undercoat layer between the support and an emulsion layer, in an intermediate layer between two emulsion layers or between an emulsion layer farthest from the support and the protective antistress layer or in the antistress layer itself is not excluded. The amount of such hydrophilic amphoteric block copolymer may range from 0.05 up to 250 $mg/m^2$, more preferably from 0.5 to 100 $mg/m^2$, still more preferably from 0.5 up to 10 $mg/m^2$ and most preferably from 1 to 5 $mg/m^2$.

Said hydrophilic amphoteric block copolymer can also be present in one or more treating solutions applied onto said imaging element. Examples of such treating solutions include processing solutions applied after image-wise exposure of the silver halide photographic materials according to the invention. Examples of processing solutions are alkaline processing liquids, e.g. developers or activators, neutralizing liquids (also called stabilizing liquids), rinsing liquids and finishers.

Gelatinous emulsions according to the present invention have silver chloride, silver chlorobromide, silver chloroiodide or silver chlorobromoiodide grains, wherein at least 70% of a total projected area of all grains is provided by {111} tabular grains having an average aspect ratio of more than 2:1 and an average thickness of from 0.05 to 0.25 $\mu$m, an average equivalent circular diameter of at least 0.3 $\mu$m and an average thickness of from 0.05 to 0.25 $\mu$m, wherein a percent variation on average equivalent circular diameter of said tabular grains is 30% or less and wherein a percent variation on average thickness of said tabular grains is 20% or less, further characterized by the presence of at least one compound being a hydrophilic amphoteric block copolymer containing (i) a non-ionic acrylic block comprising a sequence of units having pendant nitrile groups according to formula I and (ii) a acrylamid(in)ic block comprising a sequence of units according to formula II, said hydrophilic amphoteric block copolymer further comprising within said acrylamid(in)ic block(s) units having pendant acidic groups or salts as well as units having pendant basic groups or salts thereof.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and British Patent No. 618,061 may be used. Additions of sulphur and/or selenium and/or tellurium and gold may be carried out consecutively or simultaneously. In the latter case the addition of goldthiosulphate, goldselenosulphate or gold- tellurosulphate compounds may be recommended. A preferred chemical ripening system for {111} tabular grains rich in silver chloride has e.g. been described in EP-A's 0 443 453, 0 476 345, 0 506 009, 0 563 708, 0 638 840 and 0 862 088 and EP-Application No. 97202395, filed Aug. 1, 1997. Optionally, small amounts of compounds of Rh, Ru, Ir and of other elements of group VIII of the Periodic Table of the Elements can be added. Also reductors may be added as chemically sensitizing agents, e.g. tin compounds as described in British Patent No. 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant (s), one or more spectral sensitizer(s) or combinations of said ingredients. Chemical sensitization may be performed at high temperatures, e.g. at temperatures of more than 60° C. and more preferably even from 70° C. up to 80° C. as has been described in U.S. Pat. No. 5,494,788 and, opposite thereto in the absence of bromide, in EP-Appl. No. 97202169, filed Jul. 11, 1997.

The silver halide emulsions can be spectrally sensitized according to the spectral emission of the exposure source for which the silver halide photographic material is designed. Suitable sensitizing dyes for the visible spectral region include methine dyes such as those described by F. M. Hamer in "The Cyanine Dyes and Related Compounds", 1964, John Wiley & Sons. Dyes that can be used for this purpose include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes. In the case of a conventional light source, e.g. tungsten light, a green sensitizing dye is needed. In case of exposure by an argon ion laser a blue sensitizing dye is incorporated. In case of exposure by a red light emitting source, e.g. a LED or a He/Ne laser, a red sensitizing dye is used. In case of exposure by a semiconductor laser special spectral sensitizing dyes suited for the near infrared are required. Suitable infrared sensitizing dyes are disclosed in i.a. U.S. Pat. Nos. 2,095,854, 2,095,856, 2,955,939, 3,482,978, 3,552,974, 3,573,921, 3,582,344, 3,623,881 and 3,695,888. Preferred blue sensitizing dyes, green sensitizing dyes, red sensitizing dyes and infrared sensitizing dyes in connection with the present invention are described e.g. in EP-A 0 554 585.

In order to enhance the sensitivity in the red or near infra-red region use can be made of so-called supersensitizers in combination with red or infra-red sensitizing dyes. Suitable supersensitizers are described in Research Disclosure Vol 289, May 35 1988, item 28952. The spectral sensitizers can be added to the photographic emulsions in the form of an aqueous solution, a solution in an organic solvent or in the form of a dispersion. Suitable blue sensitizers have been described in e.g. WO 93/1522, in U.S. Pat. No. 4,520,098 and in EP-Appi. No. 97202169, filed Jul., 11, 1997. Suitable green-sensitizers have e.g. been described in EP-A 0 678 772, in EP-A 0 862 088 and in Research Disclosure No. 37312, 5 published May 1, 1995.

The silver halide emulsions may contain the usual emulsion stabilizers. Suitable emulsion stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2-27 (1952). Other suitable emulsion stabilizer s are i.a. (heterocyclic) mercapto compounds as e.g. those described in U.S. Pat. No. 5,290, 674 and the mercapto-triazol, mercapto-imidazol, mercaptothiadiazol or mercapto-oxadiazol compounds described in EP-A 0 454 149.

The silver halide emulsions may contain pH controlling ingredients. Preferably the emulsion layer is coated at a pH value near the isoelectric point of the gelatin to improve the stability characteristics of the coated layer. Other ingredients such as antifogging agents, development accelerators, wetting agents, and hardening agents for gelatin may be present. The silver halide emulsion layer may comprise light-screening dyes that absorb scattering light and thus promote the image sharpness. Suitable light-absorbing dyes are described in i.a. U.S. Pat. Nos. 4,092,168; 4,311,787; 5,344, 749; 5,380,634 and DE-A 2,453,217. Preparation methods of dispersions thereof have been disclosed in EP-A's 0 554 834 and 0 756 201.

More details about the composition, preparation and coating of silver halide emulsions can be found in e.g. Product Licensing Index, Vol. 92, December 1971, publication 9232, p. 107–109 and in Research Disclosure No. 38957, published Sep. 1, 1996.

Between the support and the silver halide emulsion layer there is preferably provided a base layer that preferably contains an anti-halation substance such as e.g. light-absorbing dyes absorbing the light used for image-wise exposure of the imaging element. As an alternative finely divided carbon black can be used as an anti-halation substance. On the other hand, in order to gain sensitivity, light reflecting pigments, e.g. titaniumdioxide can be present in the base layer. This layer can further contain hardening agents, matting agents, e.g. silica particles, and wetting agents. Suitable matting agents preferably have an average diameter of 2–10 $\mu$m and more preferably between 2 $\mu$m and 5 $\mu$m. The matting agents are generally used in a total amount in the imaging element of 0.1 g/m$^2$ to 2.5 g/m$^2$. At least part of these matting agents and/or light reflection pigments may also be present in the silver halide emulsion layer and/or in the cover layer. As a further alternative the light reflecting pigments may be present in a separate layer provided between the antihalation layer and the photosensitive silver halide emulsion layer. Like the emulsion layer the base layer is coated preferably at a pH value near the isoelectric point of the gelatin in the base layer.

In a further embodiment a backing layer is preferably provided at the non-light sensitive side of the support in the case of a single-side coated material. This layer which can serve as anti-curl layer can contain i.a. matting agents e.g. silica particles, lubricants, antistatic agents, light absorbing dyes, opacifying agents, e.g. titanium oxide and the usual ingredients like hardeners and wetting agents. The backing layer can consist of one single layer or a double layer pack.

The hydrophilic layers usually contain gelatin as hydrophilic colloid binder. Mixtures of different gelatins with different viscosities can be used to adjust the rheological properties of the layer. Like the emulsion layer the other hydrophilic layers are coated preferably at a pH value near the isoelectric point of the gelatin. But instead of or together with gelatin, use can be made of one or more other natural and/or synthetic hydrophilic colloids, e.g. albumin, casein, zein, polyvinyl alcohol, alginic acids or salts thereof, cellulose derivatives such as carboxymethyl cellulose, modified gelatin, e.g. phthaloyl gelatin, etc.

The hydrophilic layers of the imaging element, especially when the binder used is gelatin, can be hardened with appropriate hardening agents such as those of the vinyl sulphone type e.g. methylenebis(sulphonylethylene), aldehydes e.g. formaldehyde, glyoxal, and glutaraldehyde, N-methylol compounds e.g. dimethylolurea and methyloldimethylhydantoin, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts of the type, described in U.S. Pat. No. 4,063,952. Preferably used hardening agents are of the aldehyde type. The hardening agents can be used in a wide concentration range but are preferably used in an amount of 4% to 7% of the hydrophilic colloid. Different amounts of hardener can be used in the different layers of the imaging element or the hardening of one layer may be adjusted by the diffusion of a hardener from another layer.

The photographic material according to the present invention may further comprise various kinds of surface-active agents in the silver halide emulsion layer or in at least one other hydrophilic colloid layer. Examples of suitable surface-active agents are described in e.g. EP-A 0 545 452 Preferably compounds containing perfluorinated alkyl groups are used. The imaging element of the present embodiment may further comprise various other additives such as e.g. compounds improving the dimensional stability of the imaging element, UV-absorbers, spacing agents and plasticizers as described in Research Disclosure No. 38957, published Sep. 1, 1996, Chapters VI and IX.

Suitable additives for improving the dimensional stability of the imaging element are e.g. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, alpha-beta-unsaturated dicarboxylic acids, hydroxyalkyl (meth) acrylates, sulphoalkyl (meth)acrylates, and styrene sulphonic acids.

While the present invention will hereinafter be described in connection with preferred embodiments thereof, it will be understood that it is not intended to limit the invention to those embodiments.

EXAMPLES

Example 1

Emulsion A (silver chloroiodide tabular grains: comparative example)

The following solutions were prepared:

- 5.91 l of a dispersion medium (C) containing 0.47 moles of sodium chloride and 100 g of oxidized gelatine, was prepared at a temperature of 55° C.
- a solution containing 36 ml of a 1% solution of adenine (N).
- a 2.94 molar solution of silver nitrate (A1).
- a solution (1l) containing 2.93 moles of sodium chloride, 0.015 moles of potassium iodide and 42 ml of a 1% solution of adenine (B1).
- a solution (40ml) containing 14.7 millimoles of potassium iodide (B2).
- a solution (250 ml) containing 25 g of inert gelatine at 60° C. (N2).

Before the start of the precipitation solution N was added to solution C. Solution C was then stirred for 15 minutes and the pH was set to a value of 6.0.

A nucleation step was performed by introducing solution A1 and solution B1 simultaneously in dispersion medium C, both at a flow rate of 70 ml per minute during 30 seconds.

During a physical ripening time of 20 min, the temperature was increased to 70° C. and solution N2 was added.

Then a growth step was performed by introducing by double jet during 1730 seconds solution A1 at a flow rate of 10 ml/min, increasing linearly to 27.4 ml/min and solution B1 at a flow rate in order to maintain a constant mV-value, measured by a silver electrode versus a Ag/AgCl Ingold reference electrode, of +115 mV.

Then a pAg adjustment step was performed over a period of 9 min. by introducing a solution A1 at a constant flow rate of 10 ml/min in order to become a desired mV-value, measured by a silver electrode versus a Ag/AgCl Ingold reference electrode, of +135 mV.

After this pAg adjustment step the flow rate of solution A1 was increased linearly over a period of 22.5 minutes to 19.80 ml/min, while the flow rate of solution B1 was increasing in order to maintain the constant potential value of +135 mV.

Another physical ripening step of 4 minutes was performed.

A last precipitation step was performed by introducing solution B2 by single jet during 120 seconds at a constant flow rate of 20 ml/ min.

After the precipitation 56 ml of polystyrene sulfonic acid were added to the emulsion and the emulsion was stirred for 5 minutes. The pH was adjusted to a value of 3.5 and the emulsion was desalted by three consecutive washing steps with 4 l of demineralized water each.

Silver chloroiodide tabular grain emulsions having 1 mole % of iodide ions based on silver were obtained, comprising a high percentage by number (at least 80%) of tabular grains, having an aspect ratio of more than 7 which was counted from the corresponding electron microscopic photographs, having an average ECD (equivalent circular diameter) of 0.96 $\mu$m and a mean thickness of 120 nm.

Variation coefficients were calculated from the data obtained on ECD, being 0.33, whereas from photographs made by electron microscopic techniques a percent number of tabular crystals of about 14% was calculated.

Emulsion B (silver chloroiodide tabular grains: inventive example)

The following solutions were prepared:

- 5.84 l of a dispersion medium (C) containing 0.47 moles of sodium chloride, 100 g of oxidized gelatine and x g of blockcopolymer Y (see table), was prepared at a temperature of 55° C.
- a solution containing 36 ml of a 1% solution of adenine (N).
- a 2.94 molar silver nitrate solution (A1).
- a solution (1l) containing 2.93 moles of sodium chloride, 0.0147 oles of potassium iodide and 42 ml of a solution containing 1% by weight of adenine (B1).
- a solution (40ml) containing 14.7 millimoles of potassium iodide (B2).
- a solution (250 ml) containing 25 g of inert gelatine at 60° C. (N2).

Before the start of the precipitation solution N was added to solution C. Solution C was then stirred for 15 minutes and the pH was set to a value of 6.0.

A nucleation step was performed by introducing solution A1 and solution B1 simultaneously in dispersion medium C, both at a flow rate of 70 ml/min during 30 seconds.

During a physical ripening time of 20 min, the temperature was increased to 70° C. and solution N2 was added.

Then a growth step was performed by introducing by a double jet during 1730 seconds solution A1 at a flow rate of 10 ml/min, linearly increased up to 27.4 ml/min and solution B1 at a flow rate in order to maintain a constant mV-value, measured by a silver electrode versus a Ag/AgCl Ingold reference electrode, of +115 mV.

Then pAg was adjusted over a period of 9 min. by introducing solution A1 at a constant flow rate of 10 ml/min in order to get a desired mV-value, measured by a silver electrode versus a Ag/AgCl Ingold reference electrode, of +135 mV.

After this step the flow rate of solution A1 was increased linearly over a period of 22.5 minutes up to 19.80 ml/min., while the flow rate of solution B1 was increasing at a rate in order to maintain the same constant potential of +135 mV.

Another physical ripening step of 4 minutes was introduced.

A last precipitation step was performed by introducing a single jet during 120 seconds of solution B2 at a constant flow rate of 20 ml/min.

After precipitation 56 ml of polystyrene sulfonic acid was added to the emulsion and the emulsion was stirred for 5 minutes. pH was adjusted to a value of 3.5 and the emulsion was desalted by consecutively washing three times with 4 l of demineralized water.

The dimensions obtained from electron microscopic techniques of the thus obtained silver chloroiodide tabular grain emulsions having 1 mole % of iodide ions based on silver, are summerized in following Table 1.

TABLE 1

| Coat. No. (compound) | amount (in g) | ECD (μm) | var* (%) | thickness (nm) | % thicker tabs + globes | % thicker tabs |
|---|---|---|---|---|---|---|
| 1. (—) | — | 0.96 | 33 | 120 | 14 | 7.8 |
| 2. (I.1) | 1.75 | 1.00 | 35 | 137 | 21 | 15.5 |
| 3. (I.1) | 3.50 | 0.77 | 31 | — | 19 | 11.0 |
| 4. (I.1) | 8.75 | 1.02 | 30 | 129 | 16 | 10.0 |
| 5. (II.1) | 1.75 | 1.14 | 36 | 131 | 10.7 | 7.7 |
| 6. (II.1) | 3.50 | 1.18 | 32 | 128 | 6.4 | 4.6 |
| 7. (II.1) | 8.75 | 1.53 | 27 | 144 | 7 | 3.0 |
| 8. (I.2) | 8.75 | 0.89 | 35 | 265 | 17 | 10.0 |
| 9. (II.2) | 8.75 | 1.02 | 36 | 119 | 10 | 7.0 |
| 10. (II.3) | 8.75 | 1.32 | 28 | 129 | 6 | 2.0 |

compound I.1 = PLURONICS ® 31R1 (comparative)
compound II.1 = HYPAN ® MS16002 (invention)
compound I.2 = PLURONICS ® 17R4 (comparative)
compound II.2 = TETRONIC ® 1508 (invention)
compound II.3 = HYPAN ® MS16105 (invention)
var*: calculated on average equivalent circular diameter (ECD) of individual grains as determined by electrolysis.

As can be seen from Table 1, by adding PLURONICS® 31R1 an improvement was obtained for variation values when using high amounts thereof but without an exceptional decrease in the percent number of globes and thicker tabular grains (called "tabs").

Addition of HYPAN® MS16002 causes a drastic improvement (decrease) in percent variations on average volume of the grains and a remarkable and favourable decrease of the percent amount of globes and thicker tabular grains present.

Addition of PLURONICS® 17R4 at the highest concentration used doesn't cause any significant improvement: opposite thereto a remarkable thickness growth appears.

Addition of TETRONIC® 1508 does not have a favourable effect on percent variation on average volume of the grains, but has a favourable effect on the percent amount of globes and thicker tabular grains present, in that a clear decrease thereof appears.

Addition of HYPAN® MS16105 has about the same influences on percent variations on average volume of the grains and on percent amount of globes and thicker tabular grains present as was found for HYPAN® MS16002 hereinbefore. As a consequence addition of polymers did not cause an increase in thickness of the tabular grains, except for addition of PLURONICS®.

Example 2

Preparation of Emulsion B (silver chloroiodide tabular grains) as described in Example 1 was repeated, except for added amounts in the preparation thereof of gelatin, of adenine and of HYPAN® MS16002. Said amounts are summarized in Table 2, wherein results obtained for percent variations on the average thickness of the tabular grains obtained in the emulsion crystal distribution (indicated as "% var. $t_{TAB}$") and for percent variations on the thickness of all grains present in the emulsion crystal distribution (indicated as "%var. $t_{ALL}$") are further given.

TABLE 2

| Coat. No. (compound) | amount (in g) | gelatin (in g) | adenine (in ml) | % var. $t_{TAB}$ | % var. $t_{ALL}$ |
|---|---|---|---|---|---|
| 11. (II.1) | 5.00 | 25 | 35 | 20.4 | 57.3 |
| 12. (II.1) | 8.00 | 25 | 35 | 16.0 | 54.0 |
| 13. (II.1) | 2.00 | 25 | 50 | 19.9 | 54.8 |
| 14. (II.1) | 8.00 | 25 | 50 | 17.1 | 51.1 |
| 15. (II.1) | 2.00 | 100 | 20 | 51.1 | 73.3 |
| 16. (II.1) | 8.00 | 100 | 20 | 18.3 | 56.5 |

From Table 2 it becomes clear that addition during tabular grain emulsion preparation of HYPANO MS16002 makes decrease the percent variation on average thickness of the tabular grains present in the said emulsion. If a comparison is made between Coatings Nos. 11 and 12, 13 and 14, 15 and 16 respectively, it is clear that the percent variation on average thickness of all grains decreases if a higher amount of HYPAN® MS16002 as a suitable hydrophilic amphoteric block copolymer is used, which is indicative for the presence of a higher number (and thus a higher percent amount) of tabular grains.

We claim:

1. Method for preparing a gelatinous emulsion having grains rich in silver choride, wherein at least 70%, of total projected area of all grains is provided by {111} tabular grains having an average aspect ratio of more than 2:1, an average equivalent circular diameter of at least 0.3 μm and an average thickness of from 0.05 to 0.25 μm wherein a percent variation on average equivalent circular diameter of said tabular grains is 30% or less and wherein a percent variation on average thickness of said tabular grains is 20% or less and wherein said tabular grains are present in percent numerical amounts of at least 90%, said method comprising following steps:

preparing in a reaction vessel a dispersion medium comprising an initial amount of a crystal habit modifying agent;

precipitating therein silver halide crystal nuclei by double-jet precipitation of an aqueous silver nitrate and an aqueous solution comprising halide ions, wherein less than 10% by weight of a total amount of silver nitrate used is consumed;

growing said silver halide crystal nuclei by further precipitation of silver halide by means of double-jet precipitation of an aqueous silver nitrate solution and an aqueous solution comprising halide ions, wherein more than 90% by weight of a total amount of silver nitrate is consumed, characterized in that during at least one of the said steps at least one compound is added to the said reaction vessel, said compound being a hydrophilic amphoteric block copolymer containing (i) a non-ionic acrylic block comprising a sequence of units having pendant nitrile groups according to formula I and (ii) a acrylamid(in)ic block comprising a sequence of units according to formula II, said hydrophilic amphoteric block copolymer further comprising within said acrylamid(in)ic block(s) units having pendant acidic groups or salts thereof as well as units having pendant basic groups or salts thereof, wherein said formulae I and II correspond to following structures:

Formula I

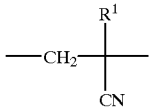

wherein $R^1$ represents hydrogen or alkyl; and

Formula II

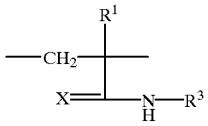

wherein $R^2$ represents hydrogen or alkyl, $R^3$ is hydrogen, alkyl or aryl and wherein X represents O or NH.

2. Method according to claim 1, wherein the said units having pendant acidic groups correspond to formula III or IV:

Formula III

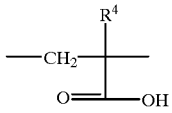

wherein $R^4$ represents hydrogen or alkyl;

Formula IV

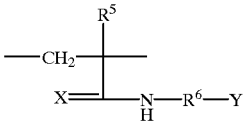

wherein $R^5$ represents hydrogen or alkyl, wherein X represents O or NH, wherein $R^6$ represents an organic linking group having at least one carbon atom and wherein —Y represents —COOH, —$OPO_3H$, —$SO_3H$ or —$OSO_3H$.

3. Method according to claim 1, wherein the said units having pendant basic groups correspond to formula V or VI:

Formula V

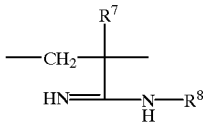

wherein $R^7$ represents hydrogen or alkyl and wherein $R^8$ represents hydrogen, alkyl or aryl;

Formula VI

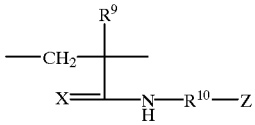

wherein $R^9$ represents hydrogen or alkyl, wherein X represents O or NH, wherein $R^{10}$ represents an organic linking group having at least one carbon atom and wherein Z represents a nitrogen containing base.

4. Method according to claim 1, wherein the hydrophilic amphoteric block copolymer comprises N-(2-sulpho-ethyl)-acrylamide and N-(2-sulpho-ethyl)-acrylamidine units.

5. Method according to claim 1, wherein said tabular {111} grains rich in-silver chloride are composed of silver chloride, silver chlorobromide, silver chloroiodide or silver chlorobromoiodide.

6. Method according to claim 5, wherein in said silver chloroiodide or silver chlorobromoiodide silver iodide is present in an amount of from 0.05 mole % up to 3 mole %.

7. Method according to claim 6, wherein said iodide is provided by means of an iodide releasing agent.

8. Method according to claim 1, wherein at least 90% of total projected area of all grains is provided by said {111} tabular grains.

9. Gelatinous emulsion having silver chloride, silver chlorobromide, silver chloroiodide or silver chlorobromoiodide grains, wherein at least 70% of a total projected area of all grains is provided by {111} tabular grains having an average aspect ratio of more than 2:1 and an average thickness of from 0.05 to 0.25 μm, an average equivalent circular diameter of at least 0.3 μm and an average thickness of from 0.05 to 0.25 μm, wherein a percent variation on average equivalent circular diameter of said tabular grains is 30% or less and wherein a percent variation on average thickness of said tabular grains is 20% or less, further characterized by the presence of at least one compound being a hydrophilic amphoteric block copolymer containing (i) a non-ionic acrylic block comprising a sequence of units having pendant nitrile groups according to formula I and (ii) an acrylamid(in)ic block comprising a sequence of units according to formula II, said hydrophilic amphoteric block copolymer further comprising within said acrylamid(in)ic block(s) units having pendant acidic groups or salts thereof as well as units having pendant basic groups or salts thereof, wherein said formulae I and II correspond to following structures:

Formula I

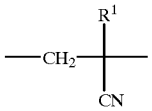

wherein $R^1$ represents hydrogen or alkyl;

Formula II

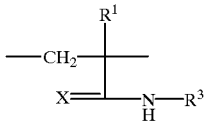

wherein $R^2$ represents hydrogen, or alkyl, wherein $R^3$ represents hydrogen, alkyl, aryl or substituted aryl and wherein X represents O or NH.

10. Emulsion according to claim 9, wherein the units having pendant acidic groups correspond to formula III or IV:

Formula III

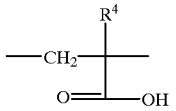

wherein $R^4$ represents hydrogen or alkyl;

Formula IV

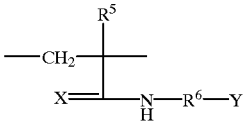

wherein $R^5$ represents hydrogen or alkyl, X is O or NH, $R^6$ is an organic linking group having at least one carbon atom and —Y is —COOH, —$OPO_3H$, —$SO_3H$ or —$OSO_3H$.

11. Emulsion according to claim 9, wherein the units having pendant basic groups correspond to formula V or VI:

Formula V

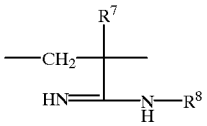

wherein $R^7$ represents hydrogen or alkyl and wherein $R^8$ represents hydrogen, alkyl or aryl;

Formula VI

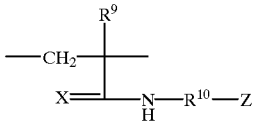

wherein $R^9$ represents hydrogen or alkyl, X represents O or NH, $R^{10}$ represents an organic linking group having at least one carbon atom and wherein Z represents a nitrogen containing base.

12. Emulsion according to claim 9, wherein the hydrophilic amphoteric block copolymer comprises N-(2-sulpho-ethyl)-acrylamide and N-(2-sulpho-ethyl)-acrylamidine units.

13. Photographic material comprising a support and on one or on both sides thereof one or more silver halide emulsion layer(s) coated from a gelatinous emulsion according to claim 9.

14. Photographic material according to claim 13, wherein said photographic material is a single-side or double-side coated radiographic material.

* * * * *